US005099816A

United States Patent [19]

Ohga et al.

[11] Patent Number: 5,099,816

[45] Date of Patent: Mar. 31, 1992

[54] ENGINE CONTROL SYSTEM

[75] Inventors: Muneyuki Ohga; Yoshinobu Kido; Takeshi Imai, all of Hiroshima, Japan

[73] Assignee: Mazda Motor Corporation, Hiroshima, Japan

[21] Appl. No.: 571,880

[22] Filed: Aug. 24, 1990

[30] Foreign Application Priority Data

Aug. 24, 1989 [JP] Japan ..... 1-217966

[51] Int. Cl.[5] ..... F02D 7/00

[52] U.S. Cl. ..... 123/481; 123/493; 123/148 F

[58] Field of Search ..... 123/481, 148 D B, 198 F, 123/41.5

[56] References Cited

U.S. PATENT DOCUMENTS 4,473,045 9/1984 Bolander et al. ..... 123/198 F
4,535,744 8/1985 Matsumura ..... 123/493
4,550,704 11/1985 Barbo et al. ..... 123/481
4,967,727 11/1990 Takahashi et al. ..... 123/481

*Primary Examiner*—Raymond A. Nelli
*Attorney, Agent, or Firm*—Fish & Richardson

[57] ABSTRACT

An engine control system of a multiple cylinder engine shifts operation between operation with all the cylinders operated and operation with a portion of the cylinders rested under a predetermined condition. When the operation with all the cylinders operated is shifted to operation with the number of the operating cylinders reduced, a control value for controlling the cylinder, such as an amount of fuel to be supplied or an ignition timing, is corrected in a direction of increasing output of the engine, the cylinder being in process of combustion immediately prior to a shift from the operation with all the cylinders operated to the operation with the number of the operating cylinders being reduced.

16 Claims, 7 Drawing Sheets

ENGINE CONTROL SYSTEM

1. FIELD OF THE INVENTION

The present invention relates to an engine control system adapted to alter the number of operating cylinders under a predetermined condition.

2. DESCRIPTION OF THE RELATED ART

Among internal combustion engines, there is an automotive engine of a type called a cylinder-number controlled engine which is designed to alter the number of the operating cylinders under a predetermined condition. This cylinder-number controlled engine is generally devised from the viewpoint of improvement in mileage, thereby permitting a reduction in the number of the operating cylinders in an operating region in which no output is particularly required.

Recently, from the viewpoint of cleaning exhaust gases, control over the number of the operating cylinders has been taken into consideration. In other words, supply of fuel to a portion of the cylinders is suspended completely or reduced to a considerably small extent in a predetermined operating region in which unburned ingredients are contained in exhaust gases at a larger rate, thereby increasing an amount of air, i.e., an amount of oxygen, in the exhaust gases discharged from the cylinder to which the supply of fuel is suspended or reduced to a considerably low extent and allowing the portion of the cylinders to function as a pump for supplying secondary air to an exhaust pathway.

It is to be noted, however, that output, i.e., torque, of the engine is temporarily reduced to a great extent when the number of the operating cylinders is decreased.

Japanese Patent Unexamined Publication (kokai) No. 2,432/1981 proposes the correction of a control value of the automotive engine in a direction of increasing output of the automotive engine immediately subsequent to completion of shifting to operation in which the number of the operating cylinders is t be reduced. As disclosed in the above Japanese patent publication, however, it is noted that a temporary reduction in the output from the automotive engine to a great extent cannot be avoided during a transient period of time when the number of the operating cylinders is to be reduced, when the output from the engine is to be increased after the number of the operating cylinders has been decreased.

SUMMARY OF THE INVENTION

The present invention has been performed under the circumstances as described hereinabove and has the object to provide an engine control system adaptable to suppress a temporary reduction in the output from the automotive engine in reducing the number of the operating cylinders.

In order to achieve the object, the present invention consists of an engine control system, comprising:

a control-value correcting means for correcting a control value such as, for example, an amount of fuel to be supplied or an ignition timing, of a cylinder to increase output of the multiple cylinder engine, said cylinder being in process of combustion immediately prior to the number of the operating cylinders being reduced, when the number of the operating cylinders is reduced.

With the arrangement, the present invention permits a temporary increase in the output from the engine immediately prior to a reduction in the number of the operating cylinders, thereby preventing a great reduction in the output from the engine during a transient period of time to shifting to operation in which the number of the operating cylinders is decreased. In shifting the number of the operating cylinders. the output from the engine turns to a stable state by first increasing it, then decreasing it and increasing it again.

Other objects, features and advantages of the present invention will become apparent in the course of the description of the preferred embodiments, which follows, in conjunction with the accompanying drawings.

DETAILED DESCRIPTION OF THE PREFERRED EMBODIMENTS

Figure 1:
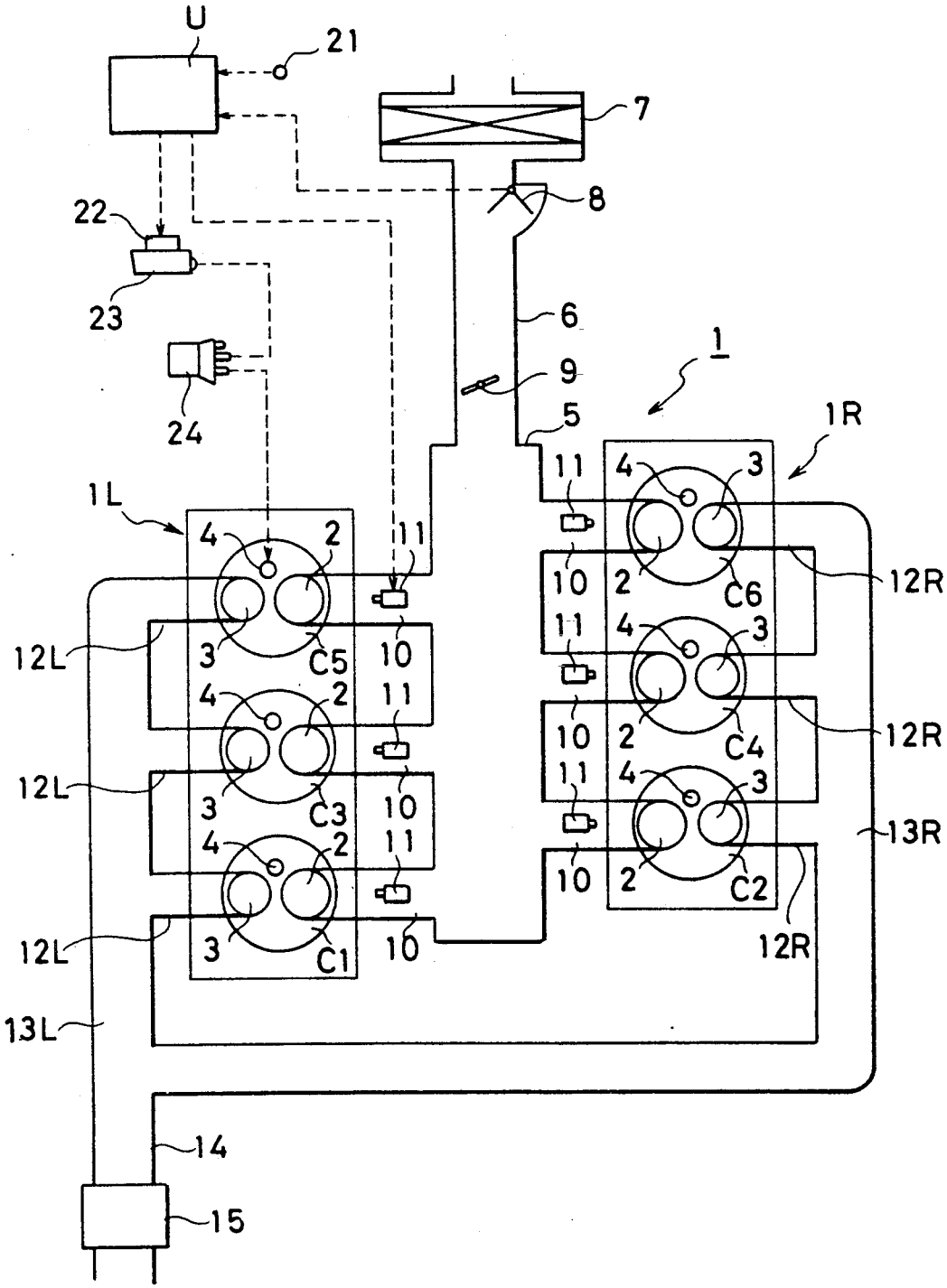
FIG. 1 is a diagrammatic representation of a whole system according to an example of the present invention.

As shown in FIG. 1, reference numeral 1 denotes a main body of an engine which is shown in this embodiment to be a V-shaped, 6-cylinder type. The V-shaped, 6-cylinder engine 1 is constructed such that its left-hand bank 1L and its right-hand bank 1R are disposed in a V-letter shape and the left-hand bank 1L has three cylinders, i.e., first cylinder C1, third cylinder C3, and fifth cylinder C5 as well as the right-hand bank lR has three cylinder, i.e., second cylinder C2, fourth cylinder C4 and sixth cylinder C6. Each of the cylinders is referred to merely by reference symbol "C" when it is not necessary that the cylinders are to be determined.

Each cylinder C has an intake port 2, an exhaust port 3 and a spark plug 4. The intake port 2 and the exhaust 3 are opened or closed by an intake valve and an exhaust valve (not shown), respectively, at a known timing in synchronization with the rotation of a crank shaft. In this embodiment, the intake valve and the exhaust valve of the cylinder to be rested are kept opened or closed at a predetermined timing, thereby allowing the rested cylinder to function as a pump for supplying secondary air.

An air intake passage for each cylinder C is provided with a surge tank 5, and a common air intake passage 6 connected to the surge tank 5 so as to feed air to the surge tank 5 past an air cleaner 7, an air flowmeter 8 and a throttle valve 9 disposed in this order from its upstream side to its downstream side. To the surge tank 5 is separately and independently connected each intake port C through an independent air intake passage 10 to which a fuel injection valve 11 is mounted.

To each of the exhaust ports 3 of the left-hand bank 1L is separately and independently connected a left-hand independent exhaust passage 12L, and three of the left-hand independent exhaust passages 12L on the side of the left-hand bank 1L are combined into a left-hand combined air exhaust Passage 13L. Likewise, a right-hand independent exhaust passage 12R is connected separately and independently to each of the exhaust ports 3 on the side of the right-hand bank 1R, and three of the right-hand independent exhaust passages 12R are combined into a right-hand combined air exhaust passage 13R. The left-hand combined air exhaust passage 13L is then combined with the right-hand combined air exhaust passage 13R into a common air exhaust passage 14 which in turn is connected to a catalyst system 15 with a ternary catalyst disposed for cleaning exhaust gases. To the catalyst system 15 is fed secondary air from the cylinder to be rested, and particularly hydrocarbons are reduced by the catalyst system 15.

As shown in FIG. 1, reference symbol U denotes a control unit comprised of a microcomputer. The control unit U is shown in this embodiment to control an amount of injection from each fuel injection valve 11 and a spark timing of each spark plug 4. To the control unit U are inputted a signal for an amount of intake air from the air flowmeter 8 and signals from a sensor group 21 which consists of a sensor for sensing the number of revolutions of the engine, a sensor for sensing an opening angle of an accelerator pedal, an idle switch for sensing the full opening of the throttle valve, a water temperature sensor for sensing the temperature of cooling water for the engine, an intake air temperature sensor for sensing the temperature of intake air, a voltage sensor for sensing the voltage of a battery, and a starter switch for starting the engine up.

Figure 4:
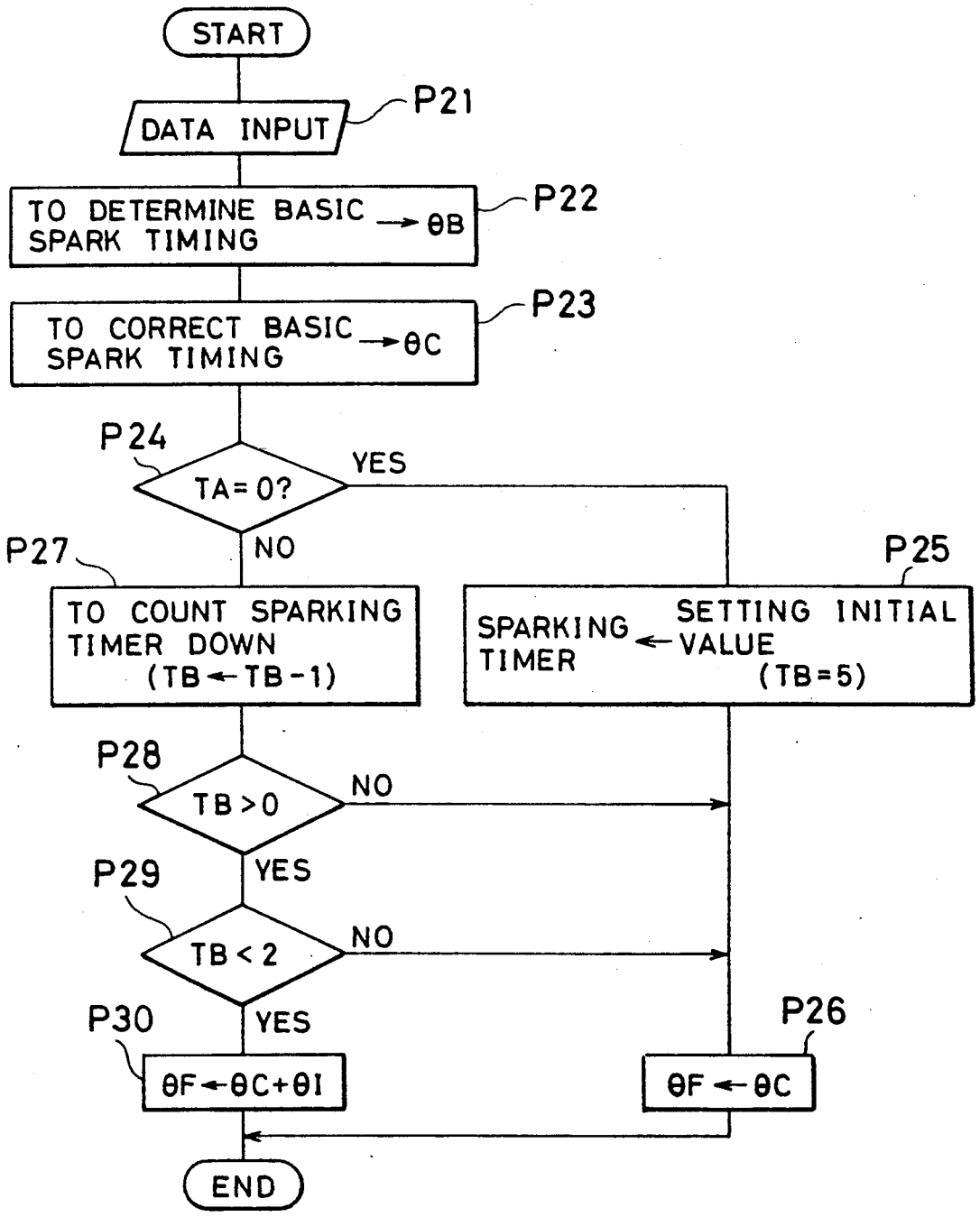

On the other hand, the control unit U generates an output signal to each fuel injection valve 11 and a spark timing signal to each igniter 22. As the spark timing signal is generated at a predetermined timing from the control unit U to the igniter 22, primary current of an ignition coil 23 is shut off at such a predetermined timing, thereby igniting the corresponding spark plug 4 through a distributor 24. In FIG. 4, pathways of the output signal from the control unit U and from the distributor 24 to the spark plug 4 are shown for the fifth cylinder C5 alone, for brevity of description, and the pathway for the other cylinders is not shown.

Figure 2A:
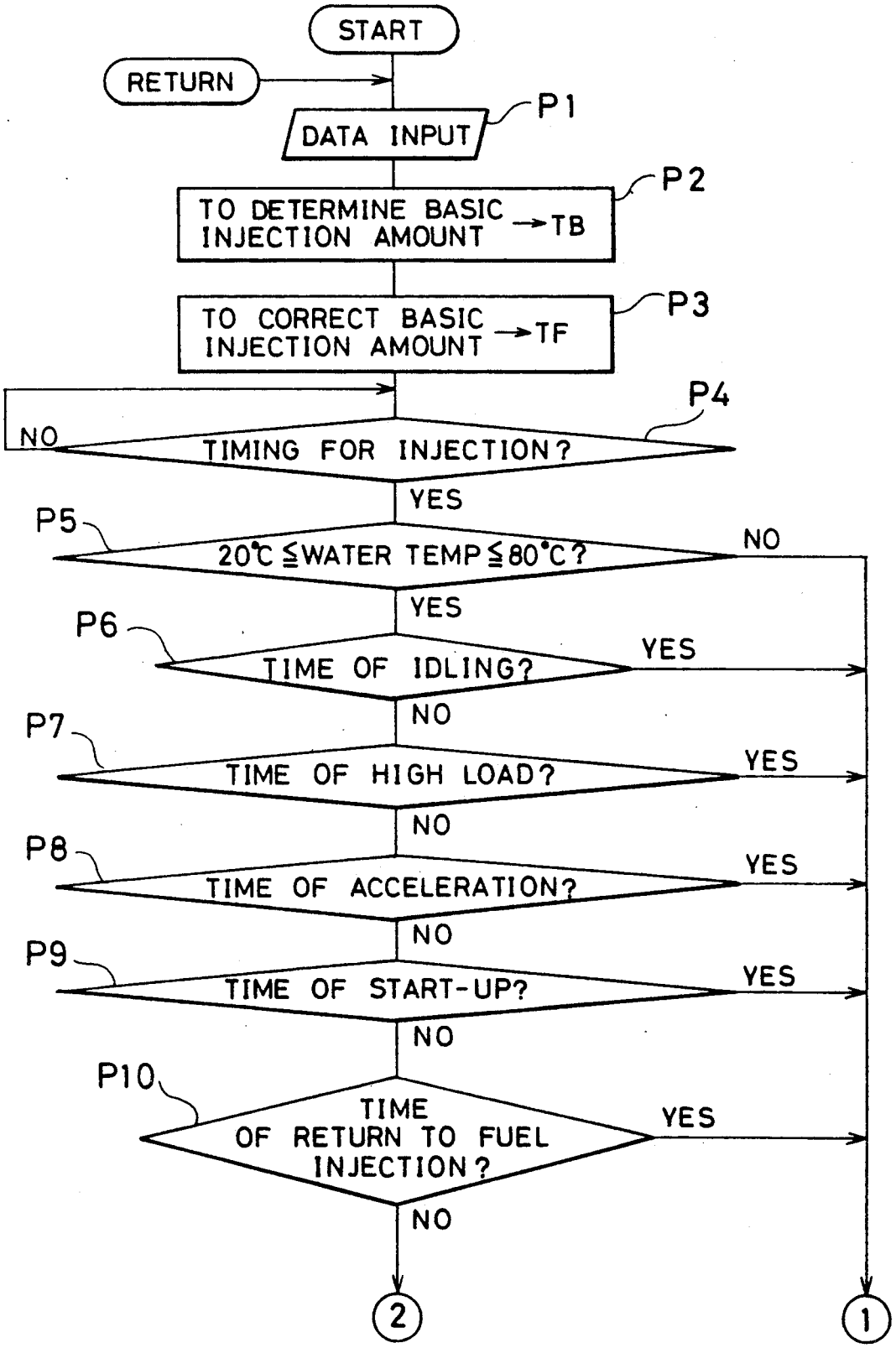
FIGS. 2A, 2B and 4 are flow charts showing an example of control according to the present invention.
Figure 2B:
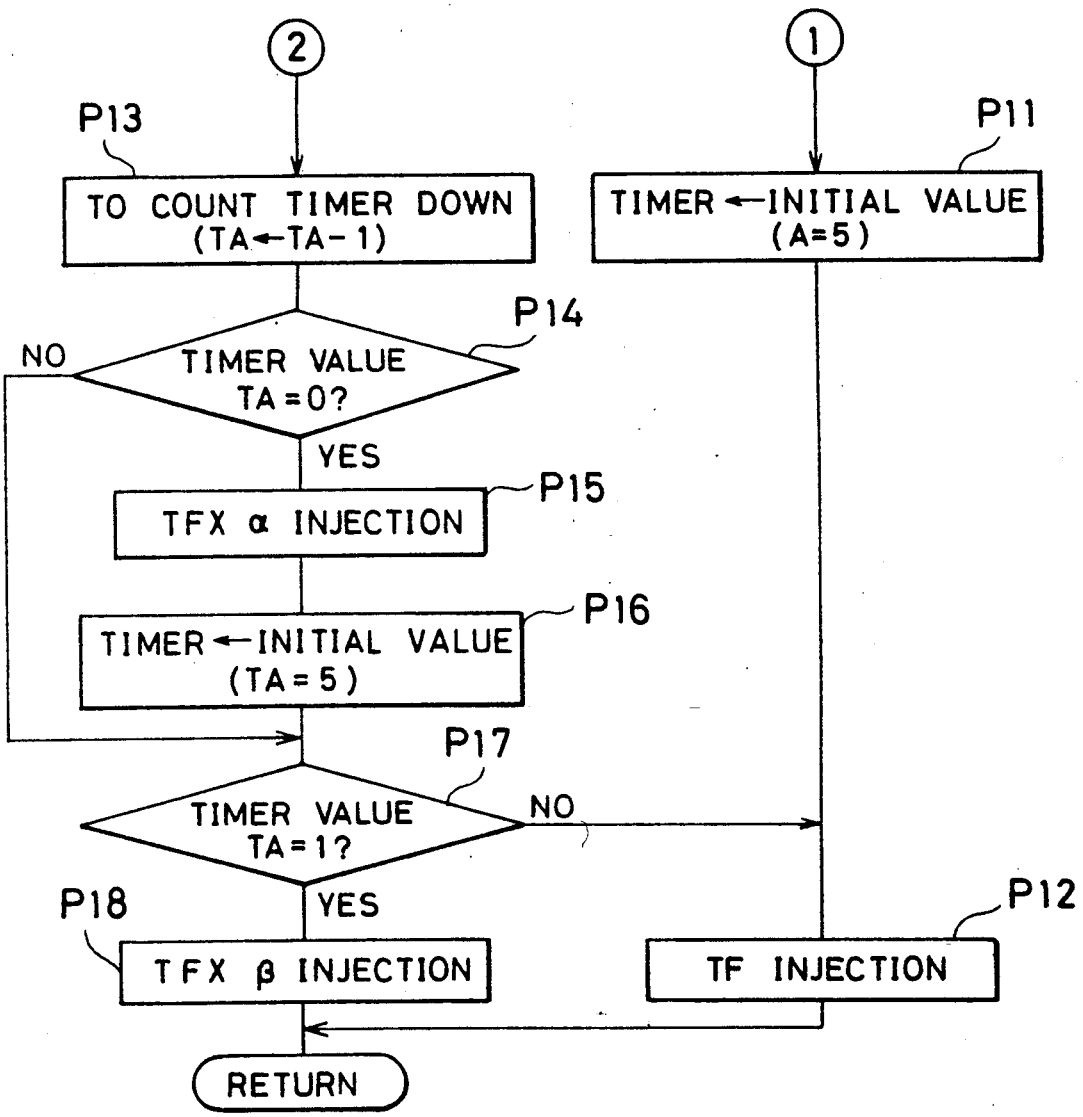

Description will be made of a process of controlling the system by the control unit U with reference to flow charts as shown in FIGS. 2A, 2B and 4. In this embodiment, the cylinder to be rested is appropriately changed by taking advantage of a timer, and an amount of injection of fuel and spark timing are used as control values for temporarily increasing the output of the engine.

Given the foregoing, description will now be made on control of the amount of injection of fuel in conjunction with FIGS. 2A and 2B.

After the system has been started, signals from the sensor 8 and the sensor group 21 are read at step P1. Then, at step P2, a basic amount of injection of fuel, TB, is determined on the basis of the number of revolutions of the engine and the amount of intake air. Thereafter, at step P3, the basic amount of injection of fuel TB is corrected on the basis of the temperature of water, temperature of intake air, acceleration, voltage of the battery and so on, thereby determining a corrected amount of injection of fuel, TF.

Then, at step P4, a decision is made to determine if it is the time for injecting fuel. When the result of decision at step P4 indicates that it is the time for injecting fuel, then a decision is made for the purpose to determine if a driving region is the one in which the supply of fuel to a portion of the cylinders is suspended completely or reduced to a considerably large extent at the processing from step P5 to step P10. More specifically, decisions are made to determine at step P5 if the temperature of water for cooling the engine is in the range from 20° C. to 80° C.; at step P6 if it is the time of idling running; at step P7 if it is the time of high load; at step P8 if it is the time of acceleration; at step P9 if it is the time for starting the engine up; and at step P10 if fuel is increased again from a state in which the supply of the fuel was decreased at the time of deceleration. In other words, a decision is made at the processing from step P5 to step P10 to determine that operation is carried out by suspending or reducing the supply of fuel to a portion of the cylinders to a complete extent or to a considerably greater extent, when the following items 1) to 6) are met:

1) when the result of decision at step 5 indicates that the temperature of water for cooling the engine is within the scope ranging from 20° C. to 80° C.;
2) when it is decided at step 6 that it is not the time for idling;
3) when the result of decision at step 7 indicates that it is not the time of high load;
4) when it is decided at step 8 that it is not the time of acceleration;
5) when the result of the decision at step 9 indicates that it is not the time for starting the engine up; and
6) when the result of decision at step 10 indicates that it is not the time for increasing the supply of fuel again from a state in which the supply of fuel was decreased during deceleration.

When it is decided that the driving range is the one in which a complete suspension or a decrease in the supply of fuel to a portion of the cylinders is inhibited as a result of the processing from decision steps P5 to P10, inclusive, on the one hand, the program flow goes to step P11 at which the timer is set to an initial value, e.g., to 5 as in this embodiment. Then, at step P11, the fuel is injected in an amount equivalent to the corrected amount of injection of fuel, TF, as corrected at step P3.

If the results of decisions at the processing from steps P5 to P10, inclusive, indicate that the supply of fuel to a portion of the cylinders be suspended or reduced to a considerably large extent, the program flow goes to step P13 at which point the count of the timer is decrease by one, followed by proceeding to step P14 at which point a decision is made to determine if a timer count TA is down to zero, in order to confirm the timing for suspending or reducing the supply of fuel to the cylinder to be rested. When the result of decision at step P14 indicates that the timer value TA is zero, thereby indicating the timing at which the supply of fuel to the cylinder to be rested be suspended or reduced, then the program flow proceeds to step P15 at which fuel is injected in an amount equivalent to an amount obtained by multiplying the corrected fuel-injection amount TF corrected at step P3 by a coefficient, $\alpha$, which may be zero or a value substantially smaller than 1. Then, at step P16, the timer is set to the initial value, e.g., TA=5, followed by proceeding to step P17. If the result of decision at step P14 indicates that the timer value TA is not zero and that it is not the time for suspending or reducing the supply of fuel to the cylinder to be rested, then the program flow goes directly to step P17 without passage through steps P15 and P16.

At step P17, it is decided to determine if the timer value has reached TA=1, in order to confirm if it is the timing for injecting fuel to the cylinder which is in the process of combustion immediately prior to switching to operation to be implemented by suspending or reducing an amount of fuel. When the result of decision at step P17 indicates that the timer value is TA=1, then the program flow goes to step P18 at which fuel is injected in an amount equivalent to an amount obtained by multiplying the corrected fuel-injection amount TF by a coefficient, $\beta$, which is greater than 1, followed by the return of the program flow. When it is decided at step P17 that the timer value is not TA=1, namely, that it is not the timing for injecting fuel to the cylinder to which the supply of fuel has been suspended or reduced, then the program flow goes to step P12 in the manner as described hereinafter, followed by the return of the system.

Figure 5:
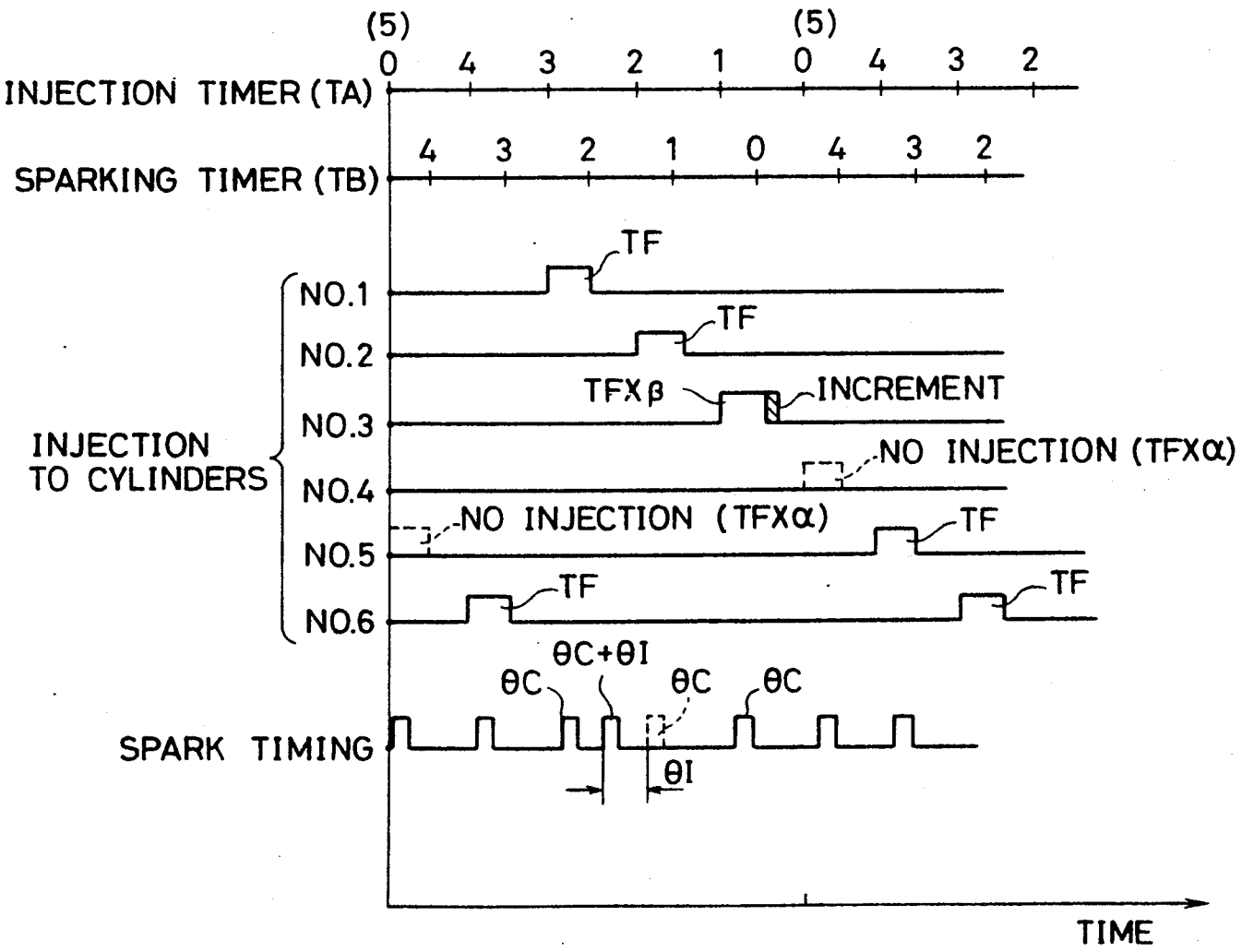
FIG. 5 is a time chart showing diagrammatically an example of content according to the present invention.

FIG. 5 is a time chart which diagrammatically shows contents of the control process as shown in FIGS. 2A and 2B. As shown in FIG. 5, when the timer value TA for the timer injecting fuel is zero (or TA=5) and it has come to the time for a suspension or a reduction in injection of the fuel to a level as low as in the amount calculated by multiplying the corrected fuel-injection amount TF by the coefficient, $\alpha$, which may be zero or a value substantially smaller than one.

Figure 3:
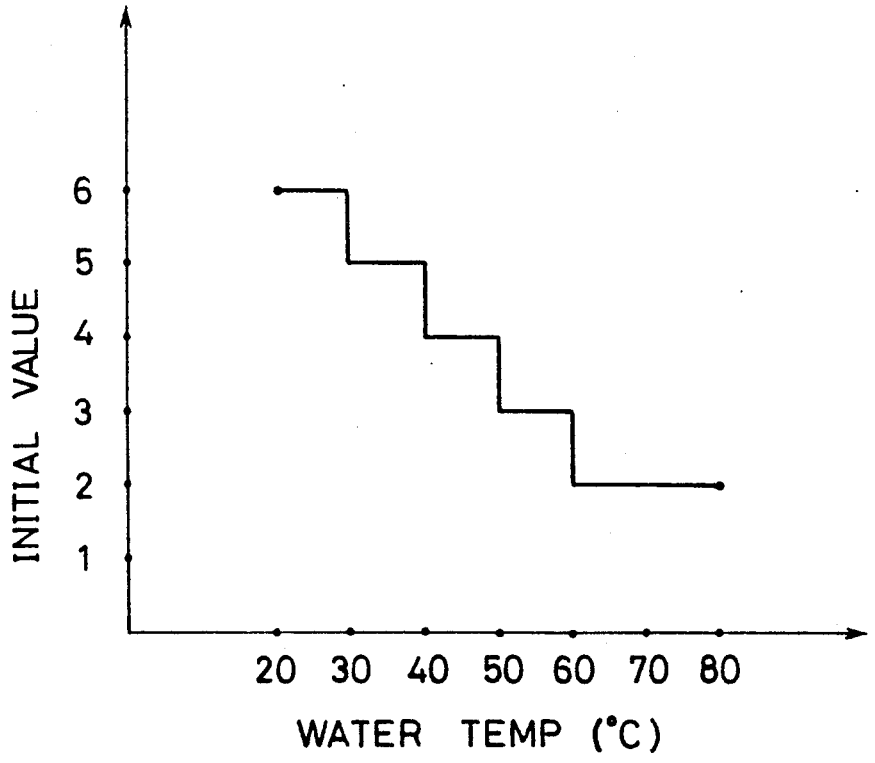
FIG. 3 is a graph showing the relationship between the temperatures of water for cooling the engine and the initial values of a timer.

FIG. 5 is a time chart showing the contents of control as shown in FIGS. 2A and 2B. As shown in FIG. 5, when the injection timer TA is zero, or TA=5, the cylinder to be rested, or cylinder C4 (No. 4), is supplied with fuel in the amount of $TF \times \alpha$ ($\alpha=0$ or $<1$), thereby suspending or reducing the amount of fuel to a considerably low level. On the other hand, the cylinder C3 (No. 3), which is in process of combustion immediately prior to the cylinder C4 (No. 4), is supplied with fuel in the amount of $TF \times \beta$ ($\beta>1$). It is further noted that the larger the initial value of the timer, the larger the number of the operating cylinders until the cylinder which follows is rested next. In this case, a frequency of resting the cylinder becomes less. As shown in FIG. 3, the initial value of the timer becomes larger as the temperature of water for cooling the engine gets lower. Further, in order to avoid only particular cylinders from being rested, it is also possible to arrange for the kind of the cylinders to be rested by setting the initial value of the timer to an odd number when the main body 1 of the engine has cylinders in even numbers, while setting the initial value of the timer to an even number when the main body 1 thereof has cylinders in odd numbers.

Description will now be made with reference to the flow chart of FIG. 4 on the case in which the output from the engine is temporarily increased due to control of the timing for ignition. As shown in the flow chart of FIG. 4, this processing is implemented by interrupting the flow charts of FIGS. 2A and 2B at a predetermined ignition timing.

First, at step P21, at least the number of revolutions of the engine and the amount of intake air (load over the engine) are read, followed by proceeding to step P22 at which a basic ignition timing, $\theta$B, is determined on the basis of the number of revolutions of the engine and the amount of intake air read at step P21. Then, at step P23, the basic ignition timing, $\theta$B, is corrected in a manner known in the state of art on the basis of the temperature of water, magnitude of acceleration, and so on, thereby determining a corrected ignition timing, $\theta$C. Data used for this correction has also been read at step P21.

Then, at step P24, a decision is made to determine if the count value TA of the timer for injecting fuel is zero, as described in FIGS., 2A and 2B. When the result of decision at step P24 indicates that the timer count is zero, on the one hand, the program flow proceeds to step P25 at which a timer for ignition has its count value TB set to an initial value which is equivalent to a value obtainable by subtracting one (1) from the initial value set for the timer for injection of fuel. The program flow then goes to step P26 at which the corrected ignition timing, $\theta$C, is set as a final ignition timing, $\theta$F, at which the ignition is executed.

On the other hand, when the result of decision at step P24 indicates that the timer count is not zero, then the program flow goes to step P27 at which the count of the timer for ignition is down. Thereafter, it is decided at steps P28 and P29 as to whether or not the value TB of the timer for ignition is zero, namely, whether or not it is the timing for igniting the cylinder which is in the course of combustion immediately prior to being rested. In other words, a decision is made at step P28 to determine if the timer value TB is larger than zero, while a decision is made at step P29 to determine if the time value TB is smaller than two (2). When the results of decisions at steps P28 and P29 indicate, respectively, that the timer value TB is greater than zero (0) and smaller than two (2), i.e., that the timer value TB for ignition is one (1), the program flow proceeds to step P30 at which a value obtained by adding a predetermined accelerating increment, $\theta$I, to the corrected ignition timing $\theta$C obtained at step P23 is intact set as the final ignition timing $\theta$F. If it is decided that the timer value TB is not one (1) as a result of decisions at steps P28 and P29, namely, that the timer value TB is less than zero (0) as a result of decision at step P28 and larger than two (2) at a result of decision at step P29, then the program flow goes to step P26 at which the corrected ignition timing, $\theta$C, is set as a final ignition timing, $\theta$F, in the same manner as described hereinabove.

FIG. 5 further represents the contents of the control of FIG. 3. As shown in FIG. 5, the spark timing for the cylinder C3 (No. 3), which becomes in process of combustion immediately prior to the cylinder C4 (No. 4) to be rested, is altered so as to be accelerated by $\theta$I from the original spark timing $\theta$C, thereby increasing the output from the engine.

Figure 6:
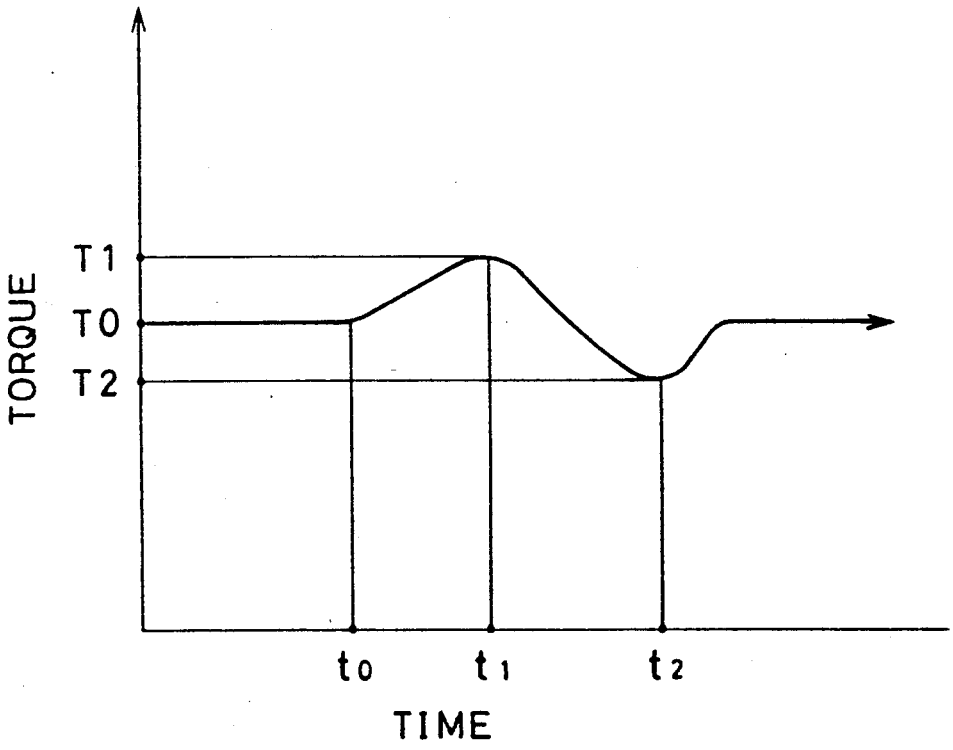
FIG. 6 is a graph showing diagrammatically the relationship of torque to an elapse of time.

FIG. 6 is a graph showing a pattern of torque varied during the control of an amount of fuel to be supplied. As shown in FIG. 6, a period of time between t0 to t1 is one during which the cylinder is in the process of combustion by accelerating ignition and increasing the supply of fuel, while a period of time between t1 to t2 is one during which the supply of fuel is suspended to a zero or reduced to a considerably large extent. As shown in FIG. 6, the magnitude of torque T0 of the engine is increased to a torque magnitude T1 ($T1>T0$) immediately before the supply of fuel is to be suspended or reduced. Therefore, it is to be noted that, even if the magnitude of torque is lowered at most to the magnitude of torque T2 ($T2<T0$), the magnitude of torque T2 does not decrease at that rate.

Description will now be made of the relationship of the initial value of the timer to the number and the kind of the cylinder to which the supply of fuel is suspended or reduced.

Generally, the smaller the initial value of the timer, the greater the number of the cylinders to be operated until the cylinder is to be rested next.

The number of the cylinders to be rested corresponds to a quotient obtained by dividing the least common multiple between the total number of the cylinders and the initial value of the timer by the initial value thereof. Specifically, for example, When the engine has six cylinders and its initial value is 5, the least common multiple is 30. The quotient obtained by the least common multiple being 30 by the initial value being 5 is 6 that is the number of the cylinders to be rested. Hence, in this example, all the cylinders are to be rested in order. Alternatively, for example, when the engine has six cylinders and the initial value is 4, the least common multiple is 12 and the quotient obtained by dividing the least common multiple by the initial value is: $12 \div 4 = 3$. In other words, three of the cylinders are to be rested. Hence, in this case, for example, the second, fourth and sixth cylinders are to be rested in this order, i.e., supplying fuel to the cylinders or igniting the cylinders, is preset so as to start from the first cylinder through the second, third, fourth and fifth cylinders to the sixth cylinder. In this example, it is also possible to rest three of the cylinders in the order from the first cylinder through the third cylinder to the fifth cylinder. It is to be noted herein that the kind and the number of the cylinders to be rested as well as the order of resting the cylinders are not restricted to particular ones.

As described hereinabove, the supply of fuel to the cylinder to be rested may be suspended completely. It is to be noted, however, that when the amount of fuel to be supplied to the resting cylinder is suspended to a completely zero level, there is no fuel left attached on an inner wall of the air intake passage for the rested cylinder during a time period when the cylinder is rested, so that the air-fuel ratio becomes lean temporarily when operation of the rested cylinder is to be started up again. In order to prevent the air-fuel ratio from becoming temporarily lean, it is preferred to keep on supplying a small amount of fuel to the rested cylinder.

The present invention may be embodied in other specific forms without departing from the spirit and scope thereof. The present embodiments as described hereinabove are therefore to be considered in all respects as illustrative and not restrictive, the scope of the invention being indicated by the appended claims, and all the changes, modifications and variations which come within the meaning and range of equivalency of the claims are therefore intended to be encompassed within the spirit and scope of the invention.

What is claimed is:

1. An engine control system of a multiple cylinder engine in which a number of operating cylinders is altered under a predetermined condition, comprising:

a combustion parameter adjusting means for adjusting a combustion parameter of a cylinder to increase the output torque of said multiple cylinder engine immediately prior to a number of operating cylinders being reduced, said cylinder being in the process of combustion when said a number of operating cylinders is reduced.

2. An engine control system as claimed in claim 1, wherein:

said combustion parameter is an amount of fuel to be supplied; and said combustion parameter adjusting means adjusts said combustion parameter to increase said amount of fuel to be supplied.

3. An engine control system as claimed in claim 2, further comprising a fuel supplying means for supplying fuel independently and separately to each of the cylinders;

wherein said combustion parameter adjusting means adjusts said combustion parameter to increase said amount of fuel to be supplied from said fuel supplying means for the cylinder in the process of combustion immediately prior to said a number of the operating cylinders being reduced.

4. An engine controls system as claimed in claim 1, wherein:

said multiple cylinder engine is an engine of an Otto cycle type to be ignited by a spark plug disposed at each of the cylinders;

said combustion parameter is an ignition timing at which ignition is produced by said spark plug; and said combustion parameter advances said ignition timing.

5. An engine control system as claimed in claim 1, wherein:

said combustion parameter comprises an ignition timing and an amount of fuel to be supplied; and said combustion parameter advances said ignition timing and increases said amount of fuel to be supplied.

6. An engine control system as claimed in claim 1, further comprising:

a water-temperature detecting means for detecting a temperature of water for cooling the multiple cylinder engine; and a means for altering the number of cylinders to be cut out so as to be reduced to a lesser number when the temperature of water detected by said water-temperature detecting means is higher than a predetermined amount.

7. An engine control system as claimed i claim 1, further comprising a timer means for renewing a count of a timer whenever an operating cylinder is altered in a predetermined sequence; and wherein a cylinder is cut out, whenever said timer means counts a predetermined number.

8. An engine control system as claimed in claim 7, wherein said timer means is rest to a predetermined initial value whenever said predetermined number is counted from said predetermined initial value, and said timer means is set so as to continue counting said predetermined number again.

9. An engine control system as claimed in claim 7, wherein said predetermined number is set to a number which is smaller by one than the number of all the cylinders.

10. An engine control system as claimed in claim 7, further comprising:

a water-temperature detecting means for detecting a temperature of water for cooling the multiple cylinder engine; and a means for altering said predetermined number so as to be increased to a greater number when the temperature of water detected by said water-temperature detecting means is lower than a predetermined amount.

11. An engine control system as claimed in claim 1, wherein:

a catalyst for cleaning exhaust gases is disposed in an exhaust system of said multiple cylinder engine; and supply of intake air to a cylinder to be cut out and a discharge of exhaust gases from said cylinder to be cut out are kept from being carried out, when an operation is carried out in which the number of the operating cylinders is decreased.

12. An engine control system as claimed in claim 11, wherein an amount of fuel to be supplied to the cylinder to be cut out is decreased but maintained above zero.

13. An engine control system as claimed in claim 11, wherein said catalyst for cleaning exhaust gases is a ternary catalyst.

14. An engine control system as claimed in claim 1, wherein operation of said combustion parameter adjusting means is inhibited at the time of idling operation.

15. An engine control system as claimed in claim 1, wherein operation of said combustion parameter adjusting means is inhibited at the time of engine startup.

16. An engine control system as claimed in claim 1, wherein operation of said combustion parameter adjusting means is inhibited at the time of increasing fuel following deceleration.

* * * * *